United States Patent [19]

Philberth et al.

[11] 4,158,186

[45] Jun. 12, 1979

[54] CORE LAMINATION FOR SHELL-TYPE CORES, PARTICULARLY FOR TRANSFORMERS

[76] Inventors: Karl Philberth; Bernhard Philberth, both of Peter-Rosegger-Strasse 6, D 8031 Puchheim, Fed. Rep. of Germany

[21] Appl. No.: 838,978

[22] Filed: Oct. 5, 1977

[30] Foreign Application Priority Data

Oct. 30, 1976 [DE] Fed. Rep. of Germany ..... 2650074

[51] Int. Cl.[2] ..... H01F 27/24

[52] U.S. Cl. ..... 336/217; 336/234

[58] Field of Search ..... 336/212, 216, 217, 233, 336/234, 178

[56] References Cited

U.S. PATENT DOCUMENTS

| | | | |
|---|---|---|---|
| 1,385,624 | 7/1921 | Kent | 336/212 X |
| 3,546,571 | 12/1970 | Fletcher et al. | 336/178 X |
| 3,631,534 | 12/1971 | Hirota et al. | 336/212 X |

FOREIGN PATENT DOCUMENTS

| | | | |
|---|---|---|---|
| 510758 | 5/1952 | Belgium | 336/217 |
| 794016 | 9/1968 | Canada | 336/217 |
| 1053096 | 3/1959 | Fed. Rep. of Germany | 336/217 |
| 1152204 | 8/1963 | Fed. Rep. of Germany | 336/212 |
| 2454419 | 5/1976 | Fed. Rep. of Germany | 336/217 |
| 67594 | 3/1958 | France | 336/217 |

*Primary Examiner*—Thomas J. Kozma

[57] ABSTRACT

The invention concerns a transformer lamination having a center leg, two outer legs and two yokes connecting these legs and having at least one joint between one side of the center leg and the adjacent yoke. The characteristic feature is that the width of the jointlessly connecting yoke is greater than that of the parted yoke. In a preferred embodiment the sum of both yoke widths is roughly 1.35 times the center leg width.

18 Claims, 6 Drawing Figures

CORE LAMINATION FOR SHELL-TYPE CORES, PARTICULARLY FOR TRANSFORMERS

The invention relates to a core lamination for shell-type cores, particularly for transformers, consisting of a plurality of alternately interleaved core laminations, which core lamination has a center leg, two outer legs parallel thereto at a certain distance, and two yokes connecting the ends of said legs, at least one joint being provided between one side of the center leg and the adjacent yoke for interleaving in the winding.

In conventional core laminations of this kind the windows formed by the center leg, two outer legs and two yokes are arranged symmetrically so that the two yokes are equal in width. The main disadvantage of this configuration is that in the shell-type core of alternately interleaved laminations, 50% of the material cross-section in the yoke consists of parted core lamination yokes. Since such a high proportion of the cross-section shows joints, the reluctance is high and the efficiency hence low.

In contrast, the object of the invention is to improve the core lamination of the type named at the beginning in such a way that a core composed of such laminations departs from the poor, parted cross-section in favour of the beneficial, jointless cross-section so reducing the reluctance and magnetic leakage and improving the efficiency.

According to the invention this object is achieved in that the yoke at the jointless end is wider than the yoke at the parted end.

The invention can best be illustrated by imagining the two windows and joints being shifted by, for instance, a few millimeters in the direction of the parted yoke of a standard M core lamination or some other well-known M core lamination. This shift does not increase the costs of material, stamping tools or interleaving work; nor is there any change in the cross-section of the yoke material in the stacked core. What this shift does achieve, however, is that less than 50% of the yoke material cross-section in the alternately interleaved core laminations consists of parted core lamination yokes. Of course, this shift in the shell-type core of interleaved laminations makes the inside length of the core window shorter than the window of an individual core lamination. However, this does not matter because the shaft length of the coil form or winding in M cores has to be shorter anyway than that of the core lamination window, as interleaving would otherwise be impossible.

In a core consisting of alternately interleaved core laminations according to the invention, the cross-sectional component consisting of parted core lamination yokes is obviously less than 50% and that of jointlessly connecting yokes is accordingly greater than 50% of the total yoke cross-section. In standard M cores for example, the cross-section formed by jointlessly connecting yokes can readily be raised by about 10% or even 15% at both ends. However, the possibility of making such a greater increase does not even need to be fully utilized, for an increase of only 3% gives a noticeable improvement, and an increase for 5% a considerable improvement. This in itself reduces considerably the reluctance, even without allowance for the special effects. The other special advantages are as follows:

Part of the magnetic flux emerging from the center leg can travel sideways along a shorter magnetic path to the jointlessly connecting core lamination yokes without crossing a joint. The lines of force make very great use of this possiblity because this path is particularly short, hence making the field strength particularly great. Thus, the axially penetrating proportion of magnetic flux is reduced considerably, so reducing not only the reactive current but also the leakage at the yoke. All in all, the region where the magnetic flux turns off the axially directed center leg to a direction parallel to the yokes is larger than that of corresponding, conventional cores, which is of advantage with grain-oriented material in particular.

In contrast to conventional shell-type-cores, the coil form of that consisting of core laminations according to the invention is practically fixed in the axial direction of the center leg. Directly after completion of interleaving in the axial direction, each core lamination according to the invention assumes roughly the position it has in the final core stack. This is advantageous for mechanical interleaving in particular.

The coil form is fixed exactly in that the length of the core lamination edge parallel to the center leg is roughly twice as wide as the jointlessly connecting yoke, plus the shaft length of the coil form.

It is most advantageous to use the invention for core laminations with joints designed as hair-line gaps about 0.1 mm. to 0.2 mm wide. Such hair-line joints which have only recently become common, are practically indispensable for mechanical core lamination interleaving. However, the reluctance in this case is so great the almost the entire magnetic flux has to escape in the undivided, adjacent lamination layers of the shell-type core. According to the invention the magnetic flux is able to escape fully into undivided, adjacent lamination layers which do not get oversaturated because the undivided cross-section of the core laminations according to the invention has been made greater at the expense of the parted cross-section.

Very beneficial characteristics are achieved when the joint of the core lamination according to the invention is asymmetrical relative to the center axis. When core laminations of this kind are interleaved alternately in four different layers in the shell-type core, there are for each joint three lamination layers which are undivided at this point and into which the magnetic flux can escape. Hence, the interfering influence of joints can be practically eliminated at astonishingly low costs.

However, core laminations of the above kind not only give the additive advantage of differing yoke widths and asymmetrical joints. They also produce an important combination effect. For practical reasons the joints normally start at the two inner lamination window corners belonging to the same yoke. Consequently, there is only on undivided lamination layer per joint at each lamination window corner and in the direct vicinity thereof. In a shell-type core consisting of normal core laminations, therefore, the reluctance is especially high in this particularly important inner window corner region. In contrast, a shell-type core consisting of core laminations according to the invention has no joint at all in the region of the clear, inside window corners, because the joints are arranged asymmetrically. Besides, the parted lamination window corner is inside the core yoke, where it can also be bypassed laterally by the magnetic flux, and the material in which the bypassing effect takes place, is not impaired by which has asymmetrical joints and is interleaved in 4 different layers, use may naturally be made of two or more different types of core laminations according to the invention, with differently located joints in alternate layers.

It is advantageous to provide the core lamination according to the invention with joints asymmetrical to the center axis, such that one joint represents a linear projection of one of the longitudinal center leg edges beyond the yoke, the other joint beginning at one window corner and extending obliquely to the center axis beyond the yoke. Joints of this kind are no problem to manufacture and give low magnetic transfer resistances in the alternately interleaved shell-type core, because these joints are long and between them there are large overlapping areas on which the magnetic flux can transfer from parted to undivided lamination layers.

To enable conventional machinery to interleave the core laminations according to the invention, despite joints extending asymmetrically to the center axis, it may be advantageous to part the center leg and from the adjacent yoke at a single joint which reaches the outer yoke edge nowhere.

Another advantageous configuration of the core lamination according to the invention, with joints extending asymmetrically to the center axis, consists in the fact that the joint angle relative to the center leg direction is, at one window corner, at least half a right angle larger than the joint angle at the other window corner. Hence, the joint projections, which coincide at the inner window corner, diverge quickly in shell-type cores consisting of groups of 4 alternately interleaved laminations, with the result that the magnetic flux can escape well before it has hardly left the inner window corner.

As regards manufacture, reluctance and magnetic leakage, it is very advantageous to use a core lamination having two joints asymmetrical to the center axis, which joints are arranged in such a way that each extends from an inner window corner at a substantically slanting, inward-directed angle to the outer yoke edge; these two joints neither intersect one another nor the imaginary straight line connecting the inner window corner to the center of the outer yoke edge. One of these joints starts at the inner window corner as a linear projection of the center leg edge, whereas the other joint starts at the inner window corner, being inclined directly toward the center axis. In this configuration the magnetic flux coming from the center leg can spread out adequately before it reaches the more inwardly situated joint. In the shell-type core consisting of groups of 4 alternately interleaved core laminations, each joint and the one directly below cover an adequately large overlapping area across practically their entire length. A large proportion of the magnetic flux is able to transfer to the yoke quite close to the inner window corner and the magnetic tension area at the outer yoke edge is small; the joint is of unusually great lenth. The core laminations are easy to interleave in the winding by hand or mechanically. A clamping frame, which merely extends closely along the outer yoke edge, is all that is needed to press the center leg ends mechanically.

The overlapping area named above is absolutely ideal in a shell-type core consisting of such core laminations. Firstly, its width meets the values of 1 mm to 2 mm desirable nowadays for the qualities and saturation to factors common to silicon iron materials. Secondly, said width is not so great anywhere that the magnetic flux has to change its direction substantially within said overlapping areas, a circumstance which causes losses in grain-oriented material.

The reluctance of the joints in a shell-type core consisting of groups of four alternately interleaved laminations according to the invention, with joints extending asymmetrically to the center axis, will be suppressed largely when the entire joint length in each core lamination is at least 4/3 times as large as the center leg width minus the difference between the two yoke widths. In this case alone will the magnetic flux at the joints be able to escape fully to undivided lamination layers, without the cross-section of said layers being constricted relative to the center leg.

When the joints extend symmetrically to the center axis, however, the entire joint length in each core lamination has to be at least twice as large as the center leg width, minus the difference between the two yoke widths, in order to achieve the same effect.

Outstanding characteristics are attained by a shell-type core consisting of core laminations according to the invention when the width of the outer legs of said core laminations is roughly 1.25 times half the center leg width, and the width of the yokes roughly 1.35 times half said width. As regards the outer legs, allowance is hence made for the optimization rule that bare legs are to be of greater cross-section than wrapped legs. As far as the yokes are concerned, optimum allowance is also made for the transverse motion of the magnetic flux and for the incorporation of adequately long joints—both for isotropic and grain-oriented material.

Several embodiments of the invention are represented diagrammatically in the drawings, in which.

Figure 1:
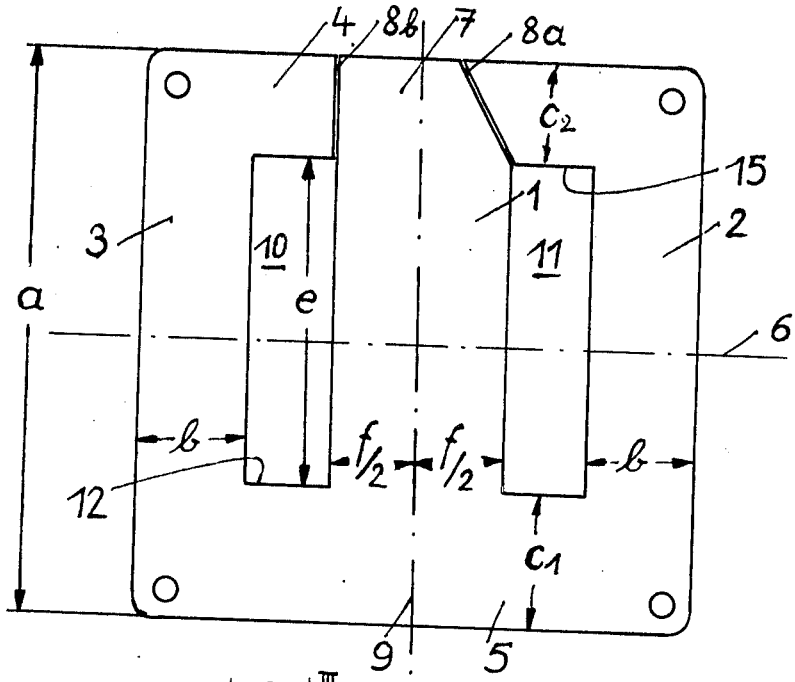
FIG. 1 is the plan view of a core lamination featuring asymmetrical joints and having outer legs and yokes wider than half the center leg.

The core lamination according to FIG. 1 is square in shape and consists of a center leg 1, two outer legs 2 and 3 parallel thereto at a certain distance, and two yokes 4 and 5 connecting the ends of said legs, two joints 8*a* and 8*b* being provided between one end 7 of center leg 1 and the adjacent yoke 4 to permit insertion in the winding not shown in FIG. 1. The joints 8*a* and 8*b* are asymmetrical to the center axis 9 of the center leg 1 and take the form of hair-line gaps. The width b of the outer legs 2 and 3 and the widths $c_2$ and $c_1$ of the yokes 4 and 5 are greater than half the width f/2 of the center leg 1. The center leg 1, the outer legs 2 and 3 and the yokes 4 and 5 enclose the windows 10 and 11, being of length e calculated in the direction of the center axis 9. According to the invention the width $c_1$ of the jointlessly connecting yoke 5 is greater than the width $c_2$ of the parted yoke 4. Hence, $c_1 > c_2$, with the result that the windows 10 and 11 are asymmetrical to the transverse axis 6. The outer edge parallel to the center leg 1 is of length a.

Figure 2:
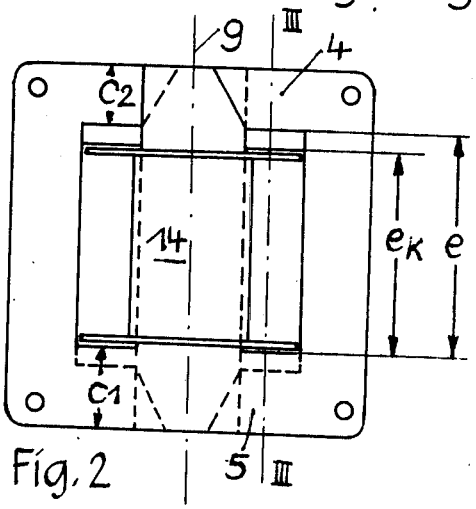
FIG. 2 is the plan view of a shell-type core comprising individual core laminations according to FIG. 1 and having a bare coil form.
Figure 3:
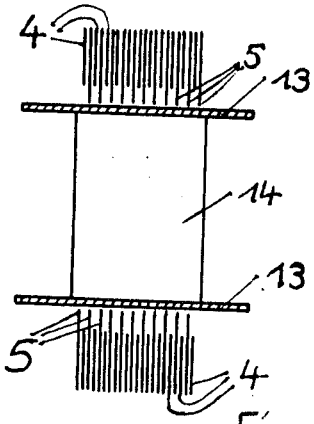
FIG. 3 is a sectional view of the shell-type core with a coil form according to FIG. 2.

The shell-type core according to FIG. 2 contains core laminations according to FIG. 1 which are interleaved in groups of four alternating layers. The inside edges 12 of the jointlessly connecting core lamination yokes 5 are practically in contact with the flanges 13 of the coil form 14 supporting the winding not shown here. In contrast, the inside edges 15 of the parted core lamination yokes 4 are spaced further away from the flanges 13 of the coil form 14 by the difference between core lamination yoke widths $c_1-c_2$. The inside length $e_K$ of the core window is shorter than the length e of the windows 10 and 11 of the individual core laminations by the difference between the core lamination yoke widths $c_1-c_2$.

Figure 4:
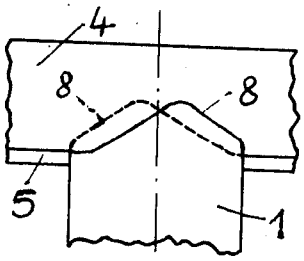
FIG. 4 is a partial plan view of a shell-type core consisting of core laminations whose joint angle relative to the center leg direction is about 90° greater at one window corner than at the other window corner.
Figure 5:
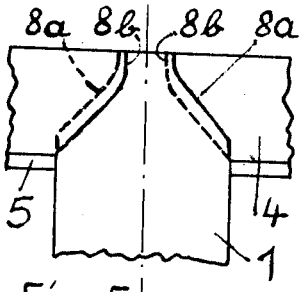
FIG. 5 is a partial plan view of a shell-type core of core laminations having asymmetrical joints passing through the yoke.
Figure 6:
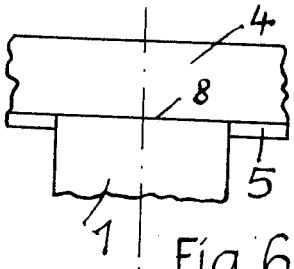
FIG. 6 is a partial plan view of a shell-type core of core laminations having symmetrical joints parallel to the yoke edge.

The core laminations used in FIGS. 4 and 6 have only one joint 8 whereas the core laminations shown in FIG. 5 have joints 8*a* and 8*b*. They are shown as solid lines. The broken lines in FIG. 4 and 5 denote the joints 8 and 8*a*/8*b* of core laminations beneath, which are situated, with regard to the center axis 9, symmetrically to the joints 8 and 8*a*/8*b* of the topmost core lamination and other core laminations in the same location.

The joint 8 shown in FIG. 4 extends substantially at an angle of almost 60° to the center axis 9 on both sides of said axis 9. This is very favourable in conjunction with grain-oriented material which has its preferred direction of orientation parallel to the center axis. The joint 8 begins at one window corner perpendicular to the center axis 9 and ends at the symmetrical window corner parallel thereto.

The joints 8*a* and 8*b* in FIG. 5 extend in turn transversely from the window corners to the outer edge of yoke 4. One joint starts at the window corner as a linear projection of the center leg edge whereas the other diverges directly at a slanting angle to the center axis 9. Both end close to the center axis 9 although they are spaced unequally apart because they are parallel in the center region. However, both end roughly parallel to the center axis 9 at the outer yoke edge. Groups of four alternately arranged core laminations are beneficial here, too.

In the embodiment according to FIG. 6 the invention applies to shell-type cores containing standard M laminations.

I claim:

1. Core laminations for shell-type cores, comprising said laminations alternately interleaved, each of said core laminations having a center leg, two outer legs parallel thereto at a certain distance, and two yokes connecting the ends of said legs, at least one joint being provided between one side of the center leg and the adjacent yoke for interleaving in the winding, and the other yoke having no joints with the center leg and the two outer legs wherein the width of the jointlessly connecting yoke is at least 5% greater than that of the parted yoke ($c_1>c_2$).

2. Core laminations as defined in claim 1, wherein each joint is designed as a hair-line gap.

3. Core laminations as defined in claim 1, wherein the joints extend asymmetrically to the center axis.

4. Core laminations as defined in claim 3, with said joints extending asymmetrically to the center axis, wherein the entire joint length is at least 4/3 times as large as the center leg width (f) minus the difference ($c_1-c_2$) between the two yoke widths.

5. Core laminations as defined in claim 3, with said joints extending asymmetrically to the center axis, wherein one joint is a linear projection of one longitudinal center leg edge beyond the yoke and wherein the other joint begins at one window corner and extends obliquely to the center axis beyond the yoke.

6. Core laminations as defined in claim 3, with said joints extending asymmetrically to the center axis, wherein the center leg end is parted from the adjacent yoke at a single joint which reaches the outer yoke edge nowhere.

7. Core laminations as defined in claim 3, with said joints extending asymmetrically to the center axis, wherein the joint angle relative to the center leg direction is, at one window corner, at least half a right angle larger than the joint angle at the other window corner.

8. Core laminations as defined in claim 3, with said joints extending asymmetrically to the center axis, wherein each of the two joints extends from an inner window corner at a substantially slanting, inward-directed angle to the outer yoke edge without intersecting one another within the yoke, and wherein one joint starts at an inner window corner as a linear projection of the center leg edge whereas the other joint starts at the other inner window corner, being inclined directly toward the center axis.

9. Core laminations as defined in claim 1, with said joints extending symmetrically to the center axis, wherein the entire joint length is approximately twice as large as the center leg width (f) minus the difference ($c_1-c_2$) between the two yoke widths.

10. Core laminations as defined in claim 1, wherein the width (b) of the outer legs is roughly 1.25 times half the center leg width and the average width ($c_1/2+c_2/2$) of the yokes is roughly 1.35 times half the center leg width.

11. Core laminations as defined in claim 1, wherein the edge length (a) parallel to the center leg is about twice the width ($c_1$) of the jointlessly connecting yoke, plus the shaft length of the coil form.

12. Core laminations as defined in claim 1, wherein the width ($c_1$) of the jointlessly connecting yoke is 5% to 10% larger than the average width ($c_1/2+c_2/2$) of the two yokes.

13. Core laminations as defined in claim 2, with said joints extending symmetrically to the center axis, wherein the entire joint length is approximately twice as large as the center leg width (f) minus the difference ($c_1-c_2$) between the two yoke widths.

14. Core laminations as defined in claim 2, wherein the width (b) of the outer legs is roughly 1.25 times half the center leg width and the average width ($c_1/2+c_2/2$) of the yokes is roughly 1.35 times half the center leg width.

15. Core laminations as defined in claim 9, wherein the width (b) of the outer legs is roughly 1.25 times half the center leg width and the average width ($c_1/2+c_2/2$) of the yokes is roughly 1.35 times half the center leg width.

16. Core laminations as defined in claim 2, wherein the width ($c_1$) of the jointlessly connecting yoke is 5% to 10% larger than the average width ($c_1/2+c_2/2$) of the two yokes.

17. Core laminations as defined in claim 9, wherein the width ($c_1$) of the jointlessly connecting yoke is 5% to 10% larger than the average width ($c_1/2+c_2/2$) of the two yokes.

18. Core laminations as defined in claim 10, wherein the width ($c_1$) of the jointlessly connecting yoke is 5% to 10% larger than the average width ($c_1/2+c_2/2$) of the two yokes.

* * * * *